United States Patent [19]

Gilb

[11] 4,062,167

[45] Dec. 13, 1977

[54] TUBULAR STRUT WITH ASYMETRICAL END DESIGN AND DRAWN HOLE

[75] Inventor: Tyrell T. Gilb, Berkeley, Calif.

[73] Assignee: Simpson Manufacturing Co., Inc., San Leandro, Calif.

[21] Appl. No.: 802,357

[22] Filed: June 2, 1977

[51] Int. Cl.[2] ..... E04C 3/18

[52] U.S. Cl. ..... 52/693; 403/217

[58] Field of Search ..... 52/690–697, 52/634–638, 720, 721, 737, 738; 403/217, 232

[56] References Cited

U.S. PATENT DOCUMENTS

| | | | |
|---|---|---|---|
| 3,268,251 | 8/1966 | Troutner | 52/693 X |
| 3,352,070 | 11/1967 | Raynes | 52/693 |
| 3,857,218 | 12/1974 | Gilb | 52/692 X |
| 3,925,951 | 12/1975 | Jackson et al. | 52/693 |
| 3,961,455 | 6/1976 | Peters | 52/693 |

*Primary Examiner*—J. Karl Bell

*Attorney, Agent, or Firm*—James R. Cypher

[57] ABSTRACT

An elongated tubular structural member having an asymetrical end design formed with an opening therethrough for attachment to other structural members as by a pin, rivet, bolt or other cylindrical fastener. At least one end is formed with the bulb section on one side extended to the opening with the bulb section on the other side of the strut terminating at a distance from the opening. The opening is drawn in a direction toward the side having the extended bulb section.

6 Claims, 11 Drawing Figures

TUBULAR STRUT WITH ASYMETRICAL END DESIGN AND DRAWN HOLE

BACKGROUND OF THE INVENTION

The use of trusses in building light-weight structures to withstand large loads has become common. These light-weight trusses, at an early date were constructed with metal chords connected by metal bars or tubular pipes with flattened ends. Early examples of metal bars with flattened ends are the Mansfield towers for supporting electric transmission cables; U.S. Ser. No. 849,908, Apr. 9, 1907; and the Wooldridge floor truss U.S. Pat. No. 1,813,373, July 7, 1931. A major weak point in the design of these trusses was the flattened ends of the webs which failed by buckling.

In the early 1960's, particularly in the Western states, a "composite truss" came into wide usage. These trusses used the abundant supply of western wood in the chords and "borrowed" the tubular metal webs with flattened ends from the all-steel trusses used in the Eastern United States. (See the Troutner composite truss, U.S. Pat. No. 3,137,899, June 23, 1964). These trusses had a single upper and a single lower wood member. Since the connection between the metal pin and the wood chord of the Troutner composite truss was the weakest link the the truss, the use of the tubular web members with the weakened flattened ends was of secondary concern.

A major breakthrough in composite trusses was accomplished by Gilb ten years later, by locating the metal pin on the edge of the single wood chord instead of within the wood chord. This eliminated the wood splitting problem and the metal connector raised the load values in the joint considerably, but the weakest point in the truss design was the flattened end of the metal webs. Gilb was granted U.S. Pat. No. 3,857,218, Dec. 31, 1974.

Because the flattened web end was the limiting factor in the Gilb edge pin connector truss, tubing of heavier gauge than would otherwise be required was used. Gilb recognized the problem of the flattened web end and in 1973 designed webs with different end configurations in which the tube bulge on one side continued down to the edge of the hole, while on the other side, the edge of the bulge was restrained to its normal position so that a flat area 1½ inches in diameter concentric with the hole was available for attachment and insert. Because of the shape of the web ends, this project was dubbed "The Dolphin Project." Due to faulty testing procedures, the webs collapsed at low design loads and the project was aborted.

At about the same time, a separate project was run dealing with the separate problem of improving the bearing of the web on the pin. With a drilled or punched hole, this was limited to the value of the metal-to-metal contact area. The obvious improvement was tried by drawing the holes to provide increased metal-to-metal bearing area, but this project too was abandoned when it was found that the drawn hole merely caused the flat area of the web to buckle at a lower value.

SUMMARY OF THE INVENTION

Many months later, somewhat accidentally, but based upon a hunch that possibly two negatives would make a positive, an old strut with the asymmetrical end was used to run a drawn hole experiment. The hole was drawn in the web side having the extended bulb length.

Surprisingly the test result in compression on the 19 gauge 1 inch tubing as imposed upon a ½ inch pin in a truss joint of the type described in Gilb, U.S., Pat. No. 3,857,218 jumped in tested value from the prior limits of around 3,000 lbs. to a new ultimate value of 4,500 lbs.

The drawn hole, as opposed to a punched hole relocated the bearing interaction between the web and the pin to some distance in the direction of the draw from the centroid line of the web specimen. In the particular case at hand this was approximately 3/16 inch. A continuation of this centroid line up through the body of the tube had the effect of displacing the flattened side measurably outboard of the centroid line in the other direction, as opposed to the extended bulb section located on the same side. This resulted in a new symmetry in compression around the true centroid line, effectively increasing the $L/r$ values over that attained by symmetrically flattened end designs.

The strut or web of the present invention has applications in the truss industry and the metal scaffolding industry. In the scaffolding industry, it has always been necessary to brace with two crossed tension members, as the compression value is limited by the present flat-end designs; although the $L/r$, in many cases, qualifies the part as a potential compression member. Using the present strut, the web can meet both the tension and compression loads and thus bracing can be decreased by a factor of about 50%.

In the truss industry, use of the present type web will permit the use of webs several gauges lower, thereby effecting a considerable savings in metal weight.

The use of less bracing in the scaffolding industry and less metal weight in trusses will effect a reduction in initial costs and the lighter weight parts will reduce construction and erection costs.

BRIEF DESCRIPTION OF THE DRAWINGS

FIG. 8 is taken along lines 8—8 of FIG. 9.

DESCRIPTION OF THE PREFERRED EMBODIMENTS OF THE INVENTION

Figure 1:
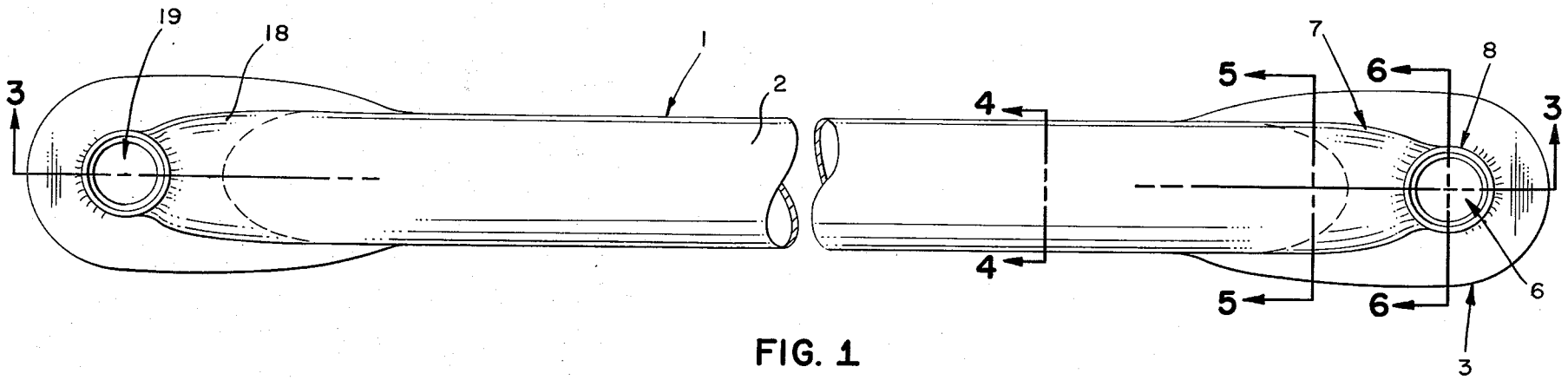
FIG. 1 is a top plan view of a strut made in accordance with the present invention.
Figure 2:
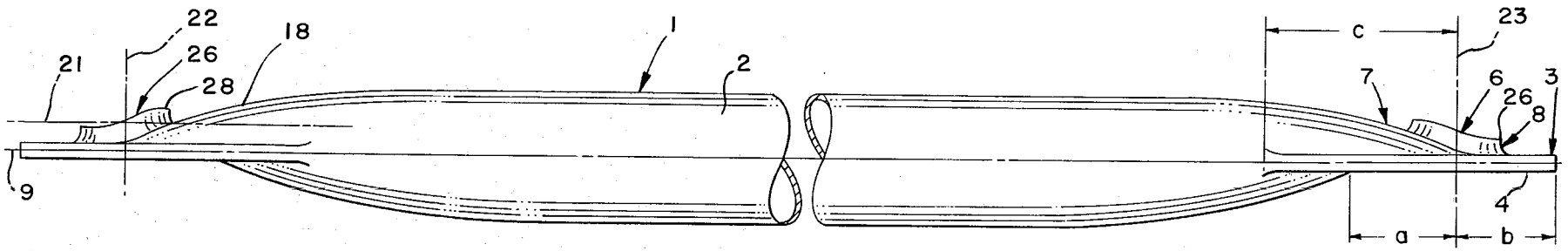
FIG. 2 is a side elevation view of the strut shown in FIG. 1.
Figure 3:
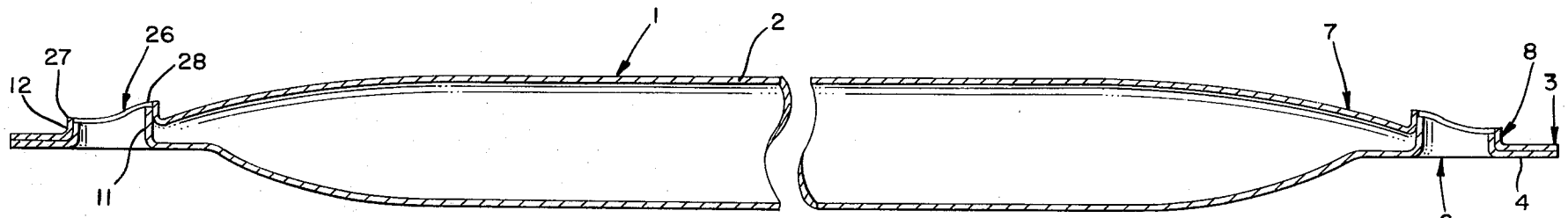
FIG. 3 is a cross section of the strut taken along line 3—3 of FIG. 1.
Figure 4:
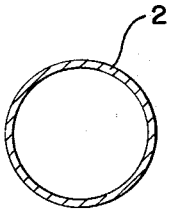
FIG. 4 is a cross section of the strut taken along line 4—4 of FIG. 1.

Referring to FIGS. 1 - 6, the structural member 1 of the present invention consists briefly of a tubular body section 2 having a generally uniform cross section as indicated in FIG. 4. At least one end 3 of the body section is formed with a flattened surface 4 on one side. The end 3 is formed with an opening 6 therethrough. Opposite the flattened surface, an extended bulb section 7 extends to the opening 6. The opening is drawn forming an annular flange 8 which extends in the direction of the side with the extended bulb section and away from the nominal centroid 9 of the tubular body section.

Figure 6:
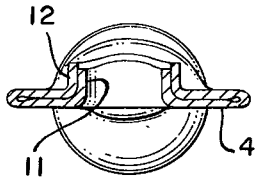
FIG. 6 is a cross section of the strut taken alone line 6—6 of FIG. 1.
Figure 5:
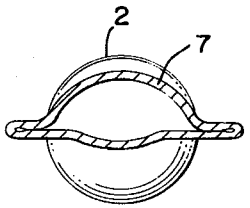
FIG. 5 is a cross section of the strut taken along line 5—5 of FIG. 1.
Figure 7:
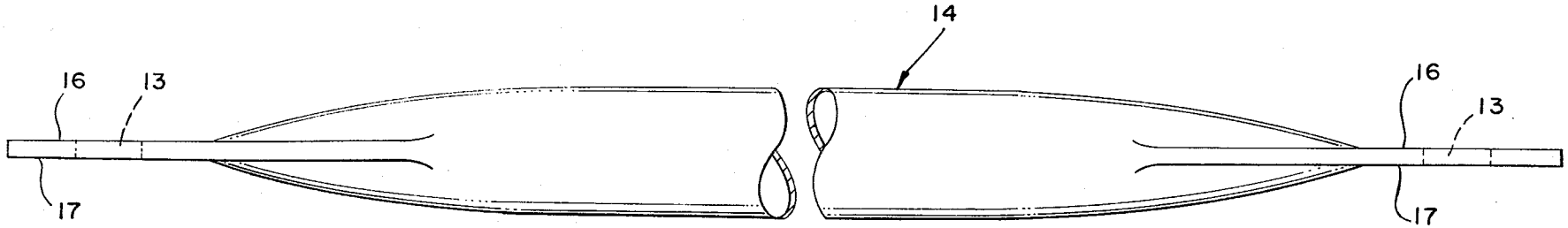
FIG. 7 PRIOR ART
FIG. 7 is a side elevation view of a strut of the prior art.

FIG. 2 clearly shows the flattened surface 4 on one side and the extended bulb section 7 on the other side. FIG. 6 shows the effect of drawing the opening. An inner flange or hub 11 is created, which is surrounded by an outer flange or hub 12. A metal pin inserted through opening 6 is thereby supported by a much greater metal area than in the prior art punched opening 13 of the prior art strut 14 with two flat surfaces 16 and 17 as shown in FIG. 7.

Figures 8, 9, 10, 11:
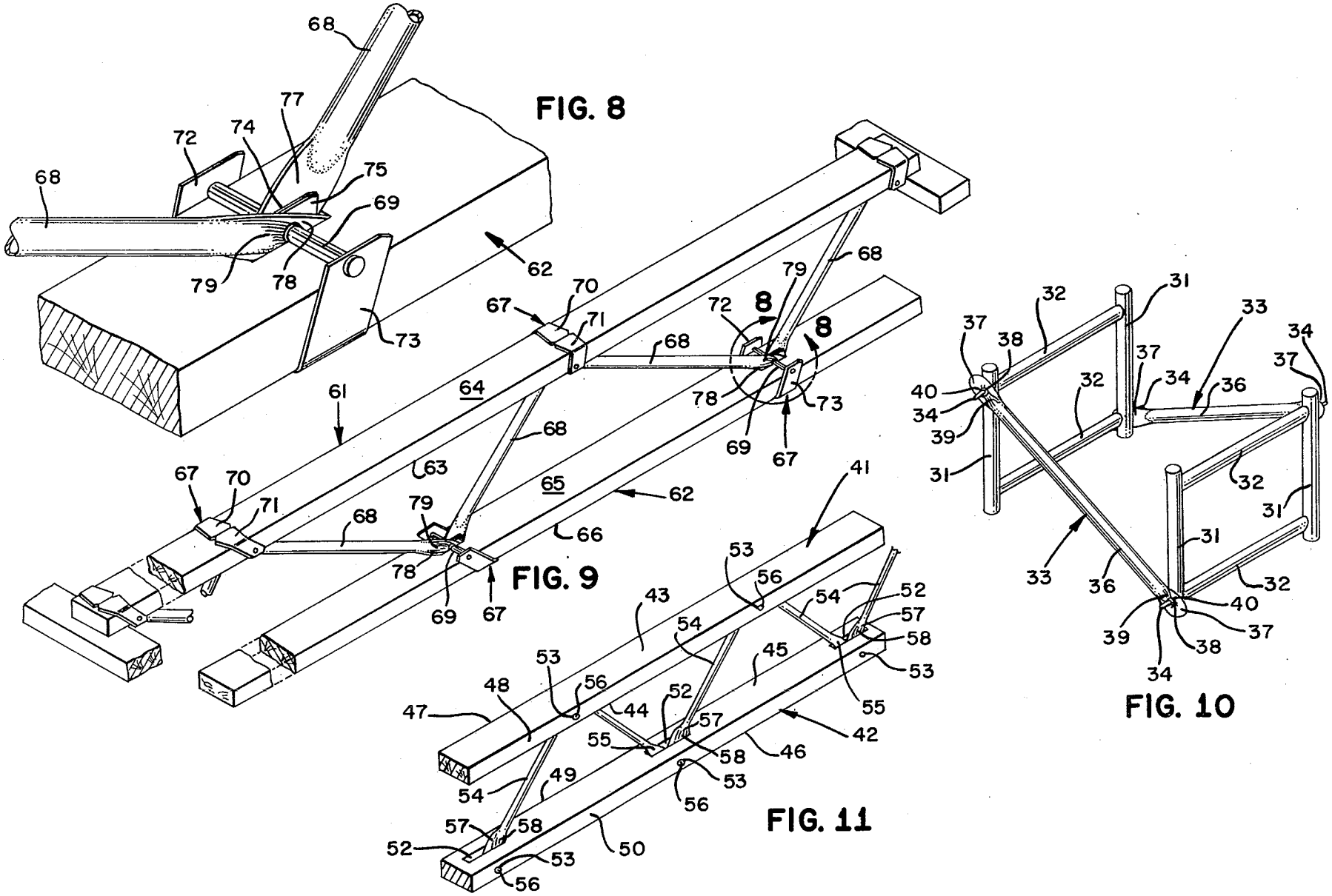
FIG. 8 is a perspective view of a typical joint in a truss of the type shown in Gilb, U.S. Pat. No. 3,857,218 with the new type struts.
FIG. 9 is a perspective view of a truss using the struts of the present invention.
FIG. 10 is a perspective view of a metal scaffold using the new type struts of the present invention.
FIG. 11 is a perspective view of still another form of truss using the webs of the present invention.

One of the uses of this new strut design which has been dubbed "Dolphin-Draw Truss Webbing" is in the type of truss and with the connector shown in FIG. 9 which is fully described in my U.S. Pat. No. 3,857,218. This new Dolphin-Draw type of web is designed primarily for use as a compression web, although it may be used as a tension web.

For practical purposes, the increased width of the Dolphin-Draw type web as it approaches the pin makes it most suitable for use in combination with an edge pin design joint assembly as shown in FIGS. 8 and 9. If used in conjunction with a center pin type joint assembly as shown in FIG. 11 substantial additional kerf material must be removed.

Since truss assembly practice dictates that the compression web be on the same side of the joints to which it is connected, but that this pattern be reversed at each panel point, both extended bulb sections 7 and 18 and drawn openings 6 and 19 should always be located on the same side of the tube in respect to the nominal centroid 9.

The Dolphin-Draw web configuration at the ends of the web eliminates localized buckling by the provision of the extended bulb areas 7 and 18 on one side of the web end and in combination therewith drawn openings 6 and 19 in the same direction as the extended bulb so that true bearing on the pin occurs at a new sub-centroid line 21 which is roughly on the intersection of the centerline 22 and 23 of the hole openings and the midpoint of the outer skewed edges 26 of the openings. The sub-centroid line 21 is of course on the same side of the web on which the extended bulb section occurs.

Referring to FIG. 2, the flat side of the end leaves the necessary area "*a*" and "*b*" which in the case of a ½ inch diameter opening is a ¾ inch radius around the hole center.

As shown in FIGS. 2 and 3, the distal edge 26 of the drawn opening is tapered with the shorter edge 27 adjacent the end of the member. Consequently, the greatest bearing area occurs along the longer side 28 of the opening thereby reducing the problem of hole elongation when inner edge 11 is in compression with a pin through the opening. Since there is less likelihood of hole elongation, there is less deformation which would contribute to the tendency of the strut to buckle in the reduced cross section area. The main reduction of the tendency of the web to buckle, of course, is due to the increased cross section in the bulb extension area indicated by the letter "*c*" in FIG. 2.

COMPARATIVE TEST RESULTS

On a standard 12¾ inches vertical compression test, the standard web (19 gauge, 1 inch tube, ½ inch hole) as shown in FIG. 7 fails by localized buckling at about 3,000 lbs. Configured in the same test with all conditions identical, the Dolphin-Draw type web of the present invention failed at approximately 4,300 lbs.

In a truss configured standard test, wherein a short section of 24 inches deep truss of the type shown in U.S. Pat. No. 3,857,218 was tested, so as to impose the load entirely upon the compresssion members, a 25¾ inches center to center specimen with conventional ends failed in compression at about 3,200 lbs. by localized buckling. In an identical truss stimulation test with all factors identical except that the compression members are formed in accordance with the Dolphin-Draw as set forth in this invention, the webs failed at an average of 4,600 lbs. by center area L/*r* failure and without any observable failure at the ends.

In summary, use of the connector as shown in FIGS. 8 and 9, and by forming the web ends as shown in FIGS. 1 – 6, the load value at the joints in the truss was dramatically increased. Failure of the truss occurred in the web member, rather than at the joint. Thus, use of the Dolphin-Draw web makes it possible for trusses to withstand greater loads or conversely, trusses of lighterweight materials can hold comparable loads.

FIG. 10 shows another use of the strut of the present invention; namely, the scaffolding industry. A typical scaffold consists of upright posts 31 connected by cross members 32. The removable bracing members 33 are attached to pins 34 which depend at right angles from the posts. The body portions 36 of the braces are tubular and the ends 37 are shaped in the same manner as the webs shown in FIGS. 1 – 6 with extended bulb sections 39 and drawn sections 40 at openings 38. An opening 38 is formed in each end of the brace to register with the pins on the posts. As above stated, since the ends are formed with Dolphin-Draw shapes, the brace can act in compression as well as in tension so that only about 50% as many brace members on a given scaffold are required.

Referring to FIG. 11, the web of the present invention is shown in a composite wood and metal truss consisting of upper and lower elongated wooden chord members 41 and 42 each having substantially flat upper and lower faces 43, 44, 45, and 46 extending between side edges 47, 48, 49 and 50 respectively. The upper chord member has slots (not shown) spaced along the length thereof which extend upwardly through the lower face, and the lower chord member has slots 52 spaced along the length thereof which extend downwardly through the upper face thereof. The slots are routed from the wood of the chord members and are disposed substantially mid-way between the side edges and the portions of the wood of the chord members between the side edges thereof and the slots are solid and integral with the remainder of the wood thereof save for cylindrical cross bores 53 which extend therethrough from side edge to side edge and intercept the slots. The slots in the upper chord member are staggered with respect to the slots in the lower chord members. Webbing 54, comprising a zigzag series of metal links, have ends with one flat side 55 with circular eye openings (not shown) therethrough. The ends of the links are loosely disposed in the slots with the eyes thereof registering with respective cross bores. Means pivotally connect the flat ends of the links with the chord members. The means comprise cylindrical metal pins 56 which extend from side to side edge of the chord members through the cross bores and eyes. The pins have driving fits in the cross bores and snug fits in the eye openings. The link end 57 opposite the flattened side is formed with an extended bulb section 58 extending to the drawn hole opening. The opening is drawn in the direction of the side with the extended bulb section and away from the centroid of the tubular body section.

Referring to FIGS. 8 and 9, the Dolphin-Draw type web is shown in combination with a composite truss which consists of upper and lower wood chords 61 and 62, each having flat inner and outer faces 63, 64, 65 and 66 and the chords have a width greater than their depth. A plurality of sheet metal connectors 67 are mounted on the chords. The web or strut members 68 have openings formed in their ends and extend between the chords. A plurality of pins 69 are mounted transversely of the chords and pivotally secure the ends of the struts at the midpoint of the pins to the connectors wherein the pivot points are located at the inner faces of the chords. The chords are formed with transverse semi-circular grooves having a depth approximately one-half the diameter of the pin for receiving the partially embedded pins. The chords are formed with slots joining the inner and outer faces at the approximate centerlines of the chords. Each of the connectors include a pair of seats 70 and 71 engaging the outside faces of the chords, each connector has a pair of legs 72 and 73 disposed in close fitting relation to the outside edges of the chords and connect the seats and opposite ends of the pin and each of the connectors has an arm 74 and 75 mounted in the slot connecting the seats and the mid-portion of the pin. The seats and legs of the connector and pin completely encapsulate the chords at their inner and outer faces and edges. The connector arm is formed with an edge flange not shown extending a substantial portion therealong and extends transversely of the chord for close fitting engagement therewith for transmitting forces from the strut members to the mid-portions of the chords. The chords are formed with channels extending from their outer faces toward their inner faces at the approximate center line of the chords for force fit receipt of the flange of the connector. The strut members are formed with flattened surfaces 77 on one side of each of their ends. On the faces 78 opposite the flattened surfaces, bulb sections 79 extend to each of the openings. The openings are drawn in the direction of the side with the extended bulb section and away from the centroid of the strut or web.

I claim:

1. An elongated structural member comprising:

a. a tubular body section having a generally uniform cross section;

b. at least one end of said body section is formed with a flattened surface on one side;

c. said end is formed with an opening therethrough;

d. on said end opposite said flattened surface, an extended bulb section extends to said opening; and e. said opening is drawn in the direction of said side with said extended bulb section and away from the centroid of said tubular body section.

2. An elongated structural member as described in claim 1 comprising:

a. both ends of said tubular body section are formed with ends as described in paragraphs *b* through *e*.

3. A structural member as described in claim 1 comprising:

a. the bulb section on said flattened side terminates a selected distance from the edge of said opening.

4. A structural member as described in claim 1 comprising:

a. the distal edge of said drawn opening is tapered with the shorter edge adjacent the end of said member.

5. A composite wood and metal truss comprising:

a. upper and lower elongate wooden chord members each having substantially flat upper and lower faces extending between side edges thereof;

b. said upper chord member having slots spaced along the length thereof which extend upwardly through the lower face thereof and said lower chord member having slots spaced along the length thereof which extend downwardly through the upper face thereof;

c. said slots are routed from the wood of the chord members and are disposed substantially mid-way between said side edges and the portions of the wood of said chord members between the side edges thereof and the slots are solid and integral with the remainder of the wood thereof save for cylindrical cross bores which extend therethrough from side edge to side edge and intercept the slots;

d. the slots in the upper chord member are staggered with respect to the slots in the lower chord members;

e. webbing comprising a zigzag series of metal links having ends with one flat side with circular eye openings therethrough;

f. the ends of the links are loosely disposed in said slots with the eyes thereof registering with respective cross bores;

g. means pivotally connecting the flat ends of said links with said chord members;

h. said means comprise cylindrical metal pins which extend from side to side edge of said chord members through said cross bores and eyes;

i. said pins have driving fits in said cross bores and snug fits in said eye openings;

j. said link end opposite said flattened side is formed with an extended bulb section extending to said opening; and k. said opening is drawn in the direction of said side with said extended bulb section and away from the centroid of said tubular body section.

6. A truss joist comprising:

a. upper and lower wood chords, each having flat inner and outer faces and said chords having a width greater than their depth;

b. a plurality of sheet metal connectors mounted on said chords;

c. a plurality of strut members having openings formed in their ends and extending between said chords;

d. a plurality of pins mounted transversely of said chords pivotally securing the ends of said struts at the midpoint of said pins to said connectors wherein the pivot points are located at said inner faces of each of said chords;

e. said chords being formed with transverse semi-circular grooves having a depth approximately one-half the diameter of said pin for receiving said partially embedded pins;

f. said chords are formed with slots joining said inner and outer faces at the approximate centerlines of said chords;

g. each of said connectors includes a pair of seats engaging the outside faces of said chords, each connector has a pair of legs disposed in close fitting relation to the outside edges of said chords and connects said seats and opposite ends of said pin and each of said connectors has an arm mounted in said slot connecting said seats and the mid-portion of said pin;

h. said seats and legs of said connector and pin completely encapsulate said chords at their inner and outer faces and edges;

i. said connector arm is formed with an edge flange extending a substantial portion therealong and extends transversely of said chord for close fitting engagement therewith for transmitting forces from said strut members to the mid portion of said chords;

j. said chords are formed with channels extending from their outer faces toward their inner faces at the approximate center line of said chords for force fit receipt of said flange of said connector;

k. said strut members are formed with flattened surfaces on one side of each of their ends;

l. on said ends opposite said flattened surfaces extended bulb sections extend to each of said openings; and m. said openings are drawn in the direction of said side with said extended bulb section and away from the centroid of said strut.

* * * * *